US005832815A

United States Patent [19]

Bollegraaf

[11] Patent Number: 5,832,815

[45] Date of Patent: Nov. 10, 1998

[54] METHOD FOR PRESSING BALES AND BALER FOR USING THAT METHOD

[75] Inventor: Heiman Salle Bollegraaf, Groningen, Netherlands

[73] Assignee: Machinefabriek Bollegraaf Appingedam B.V., Appingedam, Netherlands

[21] Appl. No.: 537,427

[22] Filed: Oct. 2, 1995

[30] Foreign Application Priority Data

Oct. 4, 1994 [NL] Netherlands ..... 9401631

[51] Int. Cl.[6] ..... B30B 9/30; B30B 7/04

[52] U.S. Cl. ..... 100/42; 100/49; 100/189; 100/190; 100/191; 100/215; 100/232; 100/233; 100/269.18

[58] Field of Search ..... 100/18, 189, 19 R, 100/35, 49, 179, 42, 190, 191, 269.18, 269.19, 269.2, 215, 232, 233

[56] References Cited

U.S. PATENT DOCUMENTS

| | | | |
|---|---|---|---|
| Re. 29,278 | 6/1977 | Vogel | 100/52 |
| 799,225 | 9/1905 | Dean | 100/179 |
| 808,996 | 1/1906 | Livengood | 100/179 |
| 833,322 | 10/1906 | Groomes | 100/179 |
| 1,079,751 | 11/1913 | Enyart | 100/179 |
| 1,088,435 | 2/1914 | Matthews | 100/179 |
| 3,368,478 | 2/1968 | Clar | 100/269.08 |
| 3,541,949 | 11/1970 | Clar | 100/269.01 |
| 3,614,925 | 10/1971 | Clar | 100/229 A |
| 3,734,005 | 5/1973 | Vogel | 100/179 |
| 4,594,942 | 6/1986 | Denneboom | 100/190 |
| 4,729,304 | 3/1988 | Gardella et al. | 100/215 |
| 4,787,308 | 11/1988 | Newsom et al. | 100/50 |
| 5,459,982 | 10/1995 | Long | 100/190 |

FOREIGN PATENT DOCUMENTS

| | | | |
|---|---|---|---|
| 0 080 719 | 6/1983 | European Pat. Off. . | |
| 2008162 | 1/1970 | France . | |
| 3412307 | 10/1985 | Germany | 100/215 |
| 91 06 487.2 | 12/1991 | Germany . | |
| 54-109261 | 8/1979 | Japan | 100/215 |
| 2032842 | 5/1980 | United Kingdom . | |

*Primary Examiner*—Stephen F. Gerrity
*Attorney, Agent, or Firm*—Merchant, Gould, Smith, Edell, Welter & Schmidt, P.A.

[57] ABSTRACT

During the pressing of bales in a baler, a portion of a press channel in front of a retracted press ram is in each case completely filled with material to be compacted. During compacting, the pressure forces exerted on the press ram have a resultant which intersects the side of the press ram directed in pressing direction below the center thereof or below the center of the press channel section at the location of that side of the press ram. The press ram shows less tendency to tilt, as a consequence of which the press ram guide is less loaded and less friction occurs between the press ram and the press channel. As a result, the bale is compressed more properly and the press ram guide wears less.

15 Claims, 1 Drawing Sheet

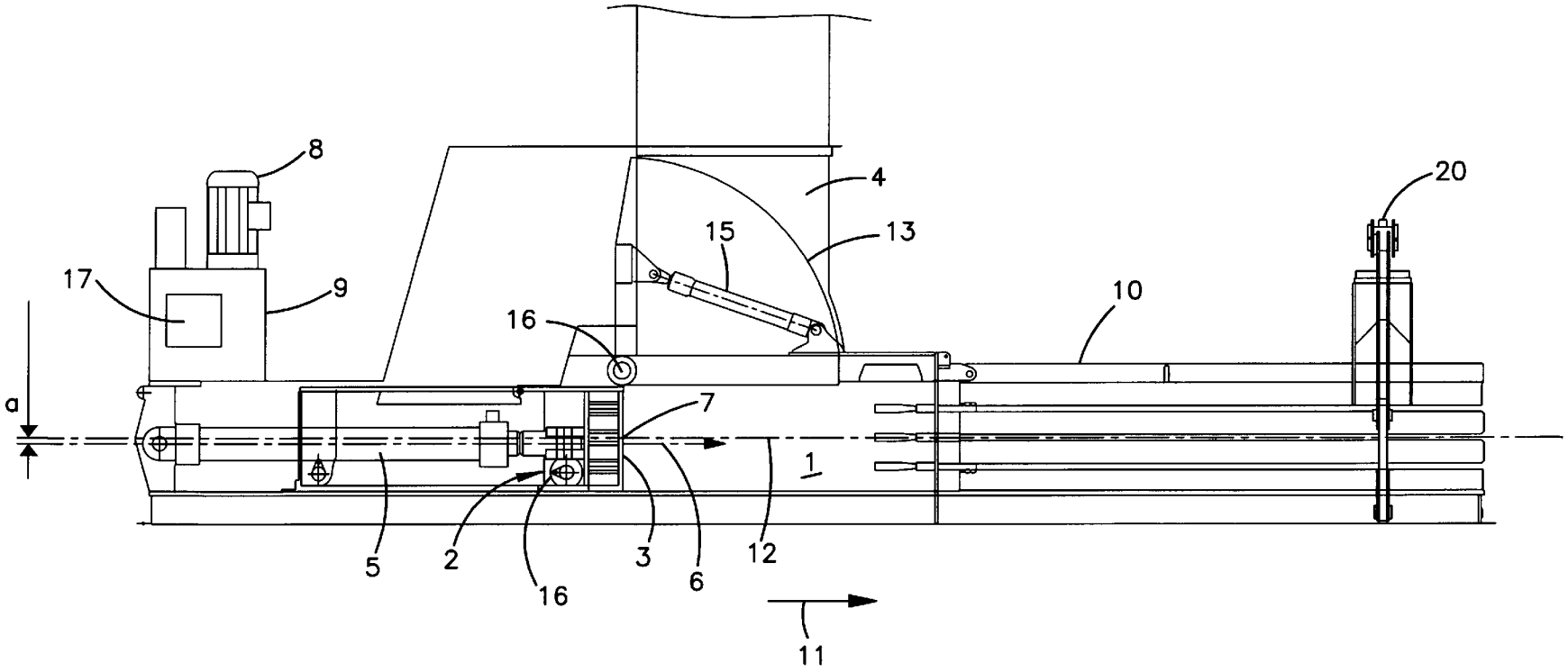
20
10
4
13
15
16
1
12
7
6
3
16
2
5
8
9
17
a
11

METHOD FOR PRESSING BALES AND BALER FOR USING THAT METHOD

BACKGROUND OF THE INVENTION

1. Field of the Invention

This invention relates to a method for pressing bales and to a baler for baling material.

2. Description of Related Art

From U.S. Pat. Nos. 3,541,949 and 3,614,925, as well as from US Reissue 29 278, it is known to exert a pressure force in a waste press along a line of action which intersects the pressure surface of the press ram below the center thereof or of the press channel. According to these documents, a press stroke is made each time when a volume of waste has gathered in front of the filling opening of a baling chamber which volume is smaller than the free volume of the press channel when the press ram is in an extreme position retracted from the priorly pressed baling goods. Thus, in each case, prior to the compacting operation, exclusively a lower portion of the baling chamber is filled with material to be pressed. The bales produced in this manner exhibit a relatively poor integrity and when a rectangular press channel is used, are generally trapezoidal.

From U.S. Pat. No. 3,368,478 it is also known to compact waste by exerting a force on a press ram which intersects the pressure surface of the press ram below the center thereof. However, in this case, no bales are formed in a press channel, but the waste is pressed into a container which is open at the top.

SUMMARY OF THE INVENTION

The object of the invention is to provide a method wherein bales of an improved firmness are obtained and there is less wear of the press ram and the press ram guide.

According to the invention, this object is realized in that the pressure forces exerted on the press ram have a resultant intersecting the side of the press ram directed in the pressing direction below the center thereof and below the center of the press channel section at the location of that side of the press ram.

A baler can be adapted to use the method according to the invention by designing the drive means and the press ram so that the resultant intersects the side of the press ram directed in pressing direction below the center thereof and below the center of the press channel section at the location of that side of the press ram.

The invention is based on the insight that when the press channel is being filled, baling goods, such as paper, synthetic materials or rags, tend to fall faster according as the packing thereof is denser, as a result of which the baling goods in lower portions of the press channel generally have a denser packing than the baling goods in upper portions of the press channel. Consequently, the resistance exerted by the baling goods during compacting is greater in lower portions of the press channel than in upper portions of the press channel.

Because the resultant of the pressure forces exerted on the press ram intersects the side of the press ram directed in pressing direction below the center thereof and/or below the center of the press channel section, the resultants of the pressure forces and the resistance produced by the material to be compacted lie closer together than with the known method, wherein the resultant of the pressure forces exerted on the press ram coincides with the center line of the press channel. As a result, when the method according to the invention is used, the press ram shows less tendency, if at all, to tilt forwards during compacting and work itself upwards: against the material to be compacted. In turn, this has as a consequence that when the invention is used, the press ram guide is less loaded and less friction (and hence less pressure loss) occurs between the press ram and the press channel. As a result, the press ram guide wears less and more net pressure force remains, so that, in particular, lower parts of the bale to be formed are compressed more properly.

The press channel can be horizontally directed or extend both horizontally and vertically, i.e. extend in an inclined manner. An inclined press channel, too, involves the phenomenon that the paper of a denser packing will gather at the bottom of the press channel. Thus, as the press channel is directed more vertically, the distance between the vertical center line of the press channel and the line along which the resultant of the forces exerted on the press ram acts should be chosen to be smaller.

The invention can be used in balers whose filling opening where the filling shaft opens into the press channel is closable by a pre-pressure valve or the like, as well as in balers whose filling shaft cannot be closed other than by the press ram and wherein for instance the press ram and cooperating cutting blades and counter-cutters provide a separation of baling goods to be compacted during a particular press stroke and pressing goods to be compacted later.

Further objects, advantages and aspects of the invention will appear from the following description of the drawing and the claims,

BRIEF DESCRIPTION OF THE DRAWING

The drawing is a cutaway side elevation of a baler according to the present invention.

DETAILED DESCRIPTION OF THE INVENTION

The baler according to the example shown, which is most preferred, has a horizontally extending press channel 1 wherein a press ram 2 with a side 3 directed in the pressing direction is displaceable forwards and backwards along the press channel 1. A tilling shaft 4 opens into the press channel 1 from above at an angle. For displacing the press ram 2 with force in a pressing direction (arrow 11), the baler comprises a press cylinder 5. For pressurizing the press cylinder 5, the baler comprises a hydromotor, driven by an electromotor 8, in a housing 9. The press channel 1 has a downstream portion 10 with a pinch-off apparatus 20 for clamping the baling goods transversely to the pressing direction. Owing to the resistance experienced by the clamped baling goods, this also forms, during the conveyance through the downstream portion 10 of the press channel 1, the medium for generating the counterpressure which is required for the pressing operation.

At the location where the filling shaft 4 opens into the press channel 1, the filling opening is closable by means of a pre-pressure valve 13 which has the shape of a segment of a circle and is pivotable about a pivot 14 and operable by a working cylinder 15.

For controlling the operation of, inter alia, the press cylinder 5 and the working cylinder 15 which drives the pre-pressure valve 13, the baler comprises control means, schematically indicated at 17, adapted to activate the press cylinder 5 to perform a press stroke each time when the pre-pressure valve 13 is closed, i.e. when the press channel 1 in front of the retracted press ram 2 is completely tilled with material to be pressed. The filling shaft 4 is preferably provided with sensors for detecting baling goods in the shaft, permitting the control means 17, in response to the baling goods in the shaft reaching a level sufficient to till the press channel 1 completely, to close the pre-pressure valve 13 and then to activate the press cylinder 5. Such sensors are known to a person skilled in the art and are therefore not further described herein.

The pressure forces that are exerted on the press ram 2 by the press cylinder 5, in operation, have a resultant 6 which intersects the side 3 of the press ram 2 directed in the pressing direction below the center 7 thereof and also below the center 12 of the press channel section at the location of the pressure side 3 or the press ram 2.

In operation, material to be compacted is dumped into the filling shaft 4, causing an amount of material to gather above the closed pre-pressure valve 13. When the press ram 2 is in its retracted position, as shown, the pre-pressure valve 13 is opened and material to be compacted falls into the press channel 2 in front of the press ram 2. The material to be compacted tends to fall faster as the packing thereof is denser, so that in general, the material to be compacted has a denser packing in lower portions of the press channel 1 than the material in upper portions of the press channel 1. When the material to be compacted has partly fallen into the press channel 1 and is partly located in the filling shaft before the pre-pressure valve 13, the pre-pressure valve 13 is closed, while the material to be compacted is pre-pressed until a specific amount is entirely located in the press channel 1. At the same time, the material to be compacted during the pressing cycle in question is separated from the material to be compacted during a next pressing cycle.

Because the material to be compacted generally has a denser packing in lower portions of the press channel 1 than the baling goods in upper portions of the press channel 1, the resistance in lower portions of the press channel 1 during compacting is greater than the resistance in upper portions of the press channel 1. Owing to the feature that the resultant 6 of the forces exerted by the press cylinder 5 intersects the side 3 of the press ram 2 directed in the pressing direction below the center of the mass of material to be compacted, the resultant 6 of the pressure forces and the resultant of the resistance (not shown) produced by the material to be compacted lie closer together than with the known baler, wherein the resultant of the forces exerted by the press cylinder coincides with the center line of the press channel.

In the baler shown, the press ram 2 shows less tendency, if at all, to tilt forwards in pressing direction during compacting, depending on the material to be compacted. As a result, the press ram guide along the upper side and the lower side of the press channel 1 and of the press ram 2 is less loaded and less friction (and hence less pressure loss) occurs between the press ram 2 and press channel 1. In particular the lower parts of the bale to be formed are compressed more properly and the press ram guide wears less.

The pressure forces exerted by the press cylinder 5, in operation, are directed parallel to the press channel 1, so that they are optimally utilized for obtaining a highest possible pressure force.

Instead of the press cylinder 5 shown, other drive means can be used as well, such as a toggle system, optionally in combination with a screw spindle.

In the baler shown, the above-described position of the resultant of the pressure forces exerted during operation is obtained in a simple manner by suspending the press cylinder 5 so that its center line intersects the side 3 of the press ram 2 directed in pressing direction below the center thereof and also below the center of the press channel section at the location of that pressure side 3.

The distance "a" between the intersection between the resultant 6 of the pressure forces exerted during operation on the ram 2 and the side 3 of the press ram 2 directed in pressing direction, and the center 7 of the side 3 of the press ram 2 directed in pressing direction or of the press channel section at the location of that side 3 of the press ram 2, is preferably at least 3% of the height of the press channel 1.

Particularly satisfactory results are achieved when the above-described distance "a" is within a range of 4–13% of the height of the press channel 1, depending on the material to be compacted.

The distance "a" can better be chosen to be slightly greater than optimum than slightly smaller than optimum, because a tendency, if any, of the press ram 2 to tilt backwards in pressing direction 2 is largely compensated by wheels 16 provided at the lower side of the press ram 2.

I claim:

1. A method for pressing bales, comprising the steps of:

filling an empty space in a press channel, said empty space extending from a retracted press ram to a medium for generating a counterpressure during pressing, from above with material to be compacted until said press channel is completely filled with material to be compacted from said retracted press ram to said medium for generating a counterpressure during pressing;

exerting pressure force on the press ram so as to displace the press ram in a longitudinal direction of the press channel, with the material to be compacted being compressed and advanced in the press channel against a counterpressure exerted by said medium for generating a counterpressure; and moving the press ram back into a retracted position;

wherein the pressure forces exerted on the press ram have a resultant force intersecting a side of the press ram directed in the pressing direction below a center of the side of the press ram and a center of the press channel section at the location of said side of the press ram.

2. A method according to claim 1, wherein a distance between the intersection between the resultant of the pressure forces exerted on the press ram during operation in the pressing direction, and at least one of the center of the side of the press ram directed in the pressing direction and the center of the press channel section at the location of said side of the press ram is at least 3.5% of the height of the press channel.

3. A method according to claim 1, wherein a distance between the intersection between the resultant of the pressure forces exerted on the press ram during operation in the pressing direction, and at least one of the center of the side of the press ram directed in the pressing direction and the center of the press channel section at the location of said side of the press ram is 4–13% of the height of the press channel.

4. A method according to claim 1, wherein during each pressing cycle, baling goods to be compacted during said pressing cycle are separated from baling goods to be compacted later.

5. A method according to claim 1, comprising the further step of pre-pressing the material to be compacted in the press channel in a direction approximately transverse to said pressing direction prior to the exerting step.

6. A baler for compacting material, comprising:

a horizontally extending press channel in which a press ram with a side directed in a pressing direction is displaceable forwards and backwards, a filling shaft opening into the press channel;

drive means for displacing the press ram with force in a pressing direction, pressure forces exerted by the drive means during operation on the press ram having a resultant direction intersecting a side of the press ram directed in the pressing direction, control means adapted to activate the drive means to carry out a press stroke when an empty space in the press channel, said empty space extending from a retracted press ram position to a medium for generating a counterpressure during pressing, is filled with material to be compacted such that the press channel is completely full with material to be compacted from said retracted press ram position to said medium for generating a counterpressure during pressing, and a detector, coupled to the control means, to detect when the empty space in the press channel is completely full with material to be compacted from said retracted press ram position to said medium for generating a counterpressure during pressing, wherein the drive means and the press ram are adapted so that said resultant direction intersects the side of the press ram directed in the pressing direction below a center of the side of the press ram directed in the pressing direction and below a center of the press channel section at the location of said side of the press ram.

7. A baler according to claim 6, wherein the drive means comprises at least one press cylinder and wherein the at least one press cylinder has a center line intersecting the side of the press ram directed in the pressing direction below the center thereof and the center of the press channel section at the location of said side.

8. A baler according to claim 6, wherein a distance between the intersection between the resultant of the pressure forces exerted by the drive means during operation on the press ram, and at least one of the center of the side of the press ram directed in the pressing direction and of the press channel section at the location of said side of the press ram is at least 3.5% of the height of the press channel.

9. A baler according to claim 6, wherein a distance between the intersection between the resultant of the pressure forces exerted by the drive means during operation on the press ram, and at least one of the center of the side of the press ram directed in the pressing direction and of the press channel section at the location of said side of the press ram is 4–135 of the height of the press channel.

10. A baler according to one claim 6, comprising means for separating material in the press channel to be compacted and material in the filling shaft to be compacted later.

11. A baler according to claim 10, wherein said means for separating material in the press channel to be compacted and material in the filling shaft to be compacted later is a pre-pressure valve clearing the filling shaft in a first position, and forming a boundary of the press channel closing the filling shaft in a second position, the pre-pressure valve movable towards the press channel for pre-pressing baling goods in the press channel when displacing from the first position to the second position.

12. A method for pressing bales, comprising the steps of:

filling an empty space in a press channel, said empty space extending from a retracted press ram to a medium for generating a counterpressure during pressing, with material to be compacted until said press channel is completely filled with material to be compacted from said retracted press ram to said medium for generating a counterpressure during pressing;

pre-pressing the material to be compacted in the press channel in a direction approximately transverse to a pressing direction; and exerting pressure force on the press ram so as to displace the press ram along a pressing direction in the press channel and compact the material against a counterpressure exerted by said medium for generating a counterpressure;

wherein the pressure forces exerted on the press ram have a resultant force intersecting a side of the press ram directed in the pressing direction below a center of the side of the press ram and a center of the press channel section at the location of said side of the press ram.

13. A baler for compacting material, comprising:

a horizontally extending press channel in which a press ram with a side directed in a pressing direction is displaceable forwards and backwards, a filling shaft opening into the press channel, drive means for displacing the press ram with force in a pressing direction, pressure forces exerted by the drive means during operation on the press ram having a resultant direction intersecting a side of the press ram directed in the pressing direction, control means adapted to activate the drive means to carry out a press stroke when an empty space in the press channel, said empty space extending from a retracted press ram position to a medium for generating a counterpressure during pressing, is filled with material to be compacted such that the press channel is completely fall with material to be compacted from said retracted press ram position to said medium for generating a counterpressure during pressing, a pre-pressure valve to pre-press the material in the press channel and form a boundary of the press channel, and a detector, coupled to the control means, to detect when the empty space in the press channel is completely full with material to be compacted from said retracted press ram position to said medium for generating a counterpressure during pressing, wherein the drive means and the press ram are adapted so that said resultant direction intersects the side of the press ram directed in the pressing direction below the center thereof and below a center of the press channel section at the location of said side of the press ram.

14. A method for pressing bales, comprising the steps of:

filling an empty space in a press channel in front of a retracted press ram from above with material to be compacted until said press channel is completely filled with material;

exerting pressure force on the press ram so as to displace the press ram in a longitudinal direction of the press channel, with the material to be compacted being compressed and advanced in the press channel, a counterpressure being exerted on the material to be compacted by the compressed material;

pinching-off compressed material in a press channel; and moving the press ram back into a retracted position, wherein the pressure forces exerted on the press ram have a resultant force intersecting a side of the press ram directed in the pressing direction below a center of the side of the press ram and a center of the press channel section at the location of said side of the press ram.

15. A baler for compacting material, comprising:

a horizontally extending press channel in which a press ram with a side directed in a pressing direction is displaceable forwards and backwards;

a filling shaft opening into the press channel;

drive means for displacing the press ram with force in a pressing direction, pressure forces exerted by the drive means during operation on the press ram having a resultant direction intersecting a side of the press ram directed in the pressing direction;

control means adapted to activate the drive means to carry out a press stroke when an empty space in the press channel in front of a retracted press ram position is filled with material to be compacted such that the press channel is completely full;

a detector, coupled to the control means, to detect when the empty space in the press channel is full; and a pinch-off apparatus positioned within the press channel downstream from the filling shaft, adapted to pinch-off previously compressed material;

wherein the drive means and the press ram are adapted so that said resultant direction intersects the side of the press ram directed in the pressing direction below a center of the side of the press ram and below a center of the press channel section at the location of said side of the press ram, and a counterpressure to the force is provided by previously compressed material in the channel.

* * * * *